United States Patent [19]

Schultz

[11] Patent Number: 4,618,177

[45] Date of Patent: Oct. 21, 1986

[54] AUTOMATIC LATCHING MECHANISM FOR OVERHEAD DOORS

[76] Inventor: Robert F. Schultz, 134 Wedgewood Ave., Woodbridge, N.J. 07095

[21] Appl. No.: 646,524

[22] Filed: Sep. 4, 1984

[51] Int. Cl.[4] ..... E05C 17/44; E05D 15/06

[52] U.S. Cl. ..... 292/338; 292/64; 292/201; 292/341.17; 292/DIG. 36; 160/201; 49/199

[58] Field of Search ..... 160/201; 49/199, 200; 292/338, 235, 225, 133, 125, 64, 63, 67, 201, 341.17, DIG. 36

[56] References Cited

U.S. PATENT DOCUMENTS

| | | | |
|---|---|---|---|
| 604,982 | 5/1898 | Habermaas | 292/164 |
| 852,816 | 5/1907 | Benjamin | 160/201 |
| 1,236,451 | 8/1917 | Koiner | 292/195 |
| 1,435,971 | 11/1922 | Mueller | 292/198 |
| 1,439,585 | 12/1922 | Trost | 292/230 |
| 1,470,029 | 1/1924 | Dixon | 42/16 |
| 1,535,403 | 4/1925 | Ellison | 292/18 |
| 1,558,917 | 10/1925 | Perkins | 292/338 |
| 1,674,649 | 1/1928 | Kucak | 292/235 |
| 1,684,814 | 9/1928 | Watkinson | 292/220 |
| 1,773,209 | 8/1930 | Tishken | 292/338 |
| 1,791,943 | 2/1931 | Turnbull | 292/198 |
| 1,815,749 | 7/1931 | Warner | 160/201 X |
| 1,932,515 | 10/1933 | Ferris | 160/201 X |
| 1,939,028 | 12/1933 | Tull | 292/33 |
| 2,123,188 | 7/1938 | Hurlbut | 292/196 |
| 2,124,969 | 7/1938 | Bagley et al. | 20/20 |
| 2,164,648 | 7/1939 | Ferris | 20/16 |
| 2,168,635 | 8/1939 | Wallace | 292/338 |
| 2,189,019 | 2/1940 | Rowe | 20/20 |
| 2,229,909 | 1/1941 | Wread | 70/148 |
| 2,259,819 | 10/1941 | Holmes | 20/16 |
| 2,308,150 | 1/1943 | Bliss | 292/198 |
| 2,331,497 | 10/1943 | Osborne | 20/16 |
| 2,589,479 | 3/1952 | Curtis | 268/59 |
| 2,699,352 | 1/1955 | Matthew | 292/272 |
| 2,807,460 | 9/1957 | Guimont | 268/74 |
| 2,818,294 | 12/1957 | Killough | 292/341.17 |
| 2,828,992 | 4/1958 | Palhegyi | 292/198 |
| 2,917,335 | 12/1959 | Pyka | 292/1 |
| 2,937,044 | 5/1960 | Petitpas | 292/99 |
| 2,971,790 | 2/1961 | Reid et al. | 292/235 |
| 3,090,427 | 3/1961 | Stroup et al. | 160/40 |
| 3,124,378 | 3/1964 | Jackson | 292/5 |
| 3,337,253 | 8/1967 | Laukzemis | 292/338 |
| 3,380,647 | 4/1968 | Harris | 292/64 |
| 3,545,132 | 12/1970 | Hormann et al. | 49/200 |
| 3,582,119 | 6/1971 | Woodworth | 292/27 |
| 3,702,710 | 11/1972 | Nutter | 292/235 |
| 3,722,936 | 3/1973 | Stubert | 292/64 |
| 3,913,970 | 10/1975 | Jardin et al. | 290/137 F |
| 4,437,694 | 3/1984 | Lillo | 292/235 |

FOREIGN PATENT DOCUMENTS

| | | | |
|---|---|---|---|
| 282300 | 8/1952 | Switzerland | 292/338 |
| 748312 | 4/1956 | United Kingdom | 292/338 |

*Primary Examiner*—Gary L. Smith
*Assistant Examiner*—Shirish Desai
*Attorney, Agent, or Firm*—Lerner, David, Littenberg, Krumholz & Mentlik

[57] ABSTRACT

A latching device for overhead-type doors mounted for movement between a closed position and a raised position with respect to an opening defined by a frame. The latching mechanism includes a pivotable arm having a pivot end and an engagement end. The pivot end of the pivotable arm is mounted above the opening for pivotable movement about a substantially horizontal axis between a first position and a second raised position. The engagement end of the arm is adapted to engage a first latch portion associated with the door when the door is in a closed position and the arm is in the first position, and also adapted to engage a second latch portion associated with the door when the door is in the raised position and the arm is in an intermediate position between the first and second positions. The arrangement of the arm relative to the door is such that the door is prevented by the arm for moving into the raised position from the closed position unless the arm is first moved toward the second position out of engagement with the first latch portion, and also such that the door is prevented by the arm for moving to the closed position from the raised position unless the arm is first moved from the intermediate position towards the second position out of engagement with the second latch portion.

12 Claims, 5 Drawing Figures

AUTOMATIC LATCHING MECHANISM FOR OVERHEAD DOORS

FIELD OF THE INVENTION

The present invention relates to latching mechanisms, and more particularly to latching mechanisms for overhead-type doors, i.e., doors mounted for movement with respect to a frame between a closed lowered position in which an opening in the frame is covered, and a raised open position to provide access through the opening. Such overhead-type doors may, for example, comprise doors for garages, warehouses or other buildings, as well as doors or closures for cabinets or other receptacles.

BACKGROUND OF THE INVENTION

Various types of latching mechanisms for overhead-type doors are well known in the art. For example, mechanisms are known for automatically latching a door when it is moved to its closed position so that simple closing of the door insures that the door will remain closed unless some positive act or effort to open the door is undertaken. Such mechanisms are advantageous for preventing unwanted entry or intrusions as well as eliminating the necessity of remembering to engage a lock or latch after the door is closed. Also, such mechanisms are useful in those instances where it might be desired that a specific sequence of operations be followed in order to open the door. For instance, automatic latching of overhead doors in their closed position is desirable with respect to doors in warehouses and the like in order to discourage attempts to open the doors with forklifts, which have often resulted in damage to the doors, as opposed to pulling of a chain or cable connected to the door. By providing an automatic latching mechanism for latching the door closed, persons could be required to disembark from the forklift and then pull on a cable connected to the door to effect opening, thus minimizing the risks of damage to the door.

Similarly, various latching mechanisms are known for automatically latching of the doors when they have been moved into their raised position to provide access through the door opening. These latter types of latching mechanisms are often desirable and advantageous in serving as safety devices to protect against injury to personnel or equipment as a result of an accidental closing of the door. In such instances, the latching mechanism serves to latch and hold the door in the raised position until some positive action or effort is undertaken to release the door.

Some of these various prior art latching or locking mechanisms are very complex and complicated. While other of the prior art mechanisms are of a relatively simplistic design, none of the prior art mechanisms of which the inventor is aware disclose a latching mechanism which is operative to automatically latch an overhead door in both the raised and lowered positions when the door is moved to such positions.

More particularly, one example of a prior art latching mechanism for automatically latching an overhead-type door when it is lowered to its closed position is shown in U.S. Pat. No. 2,917,335. This patent discloses a rather complicated latching mechanism which includes a projection secured to the overhead frame of the enclosure which is adapted to enter and engage a bracket fixed to the upper end of the door when the door is closed, the projection being held by means of a rotary-type locking mechanism. Release of the projection is achieved by means of a cable or chain connected to a portion of the rotary locking mechanism so that when the chain is pulled the rotary mechanism is moved to a position to allow the door to be opened.

U.S. Pat. No. 2,971,790 illustrates an overhead door safety device for preventing accidental dislodging or closing of a door after it has been moved to its opened position. In accordance with this reference, the safety device includes a fixture adapted to be mounted to a horizontal frame member of the door enclosure and having a pivotable stop latch or lever mounted therein. The latch member is pivotable between a first horizontal position and a second upwardly inclined position. A bracket is secured to the lower front portion of the door, and includes an upwardly facing flange which, when the door is raised, is operative to pivot the latched member upwardly to allow the bracket to pass thereby. However, when the door is in its fully raised position, any movement of the door downwardly serves to cause the outwardly protruding lip of the flange to engage the stop lever and thus prevent further downward movement of the door. In order to allow the door to close fully, the stop lever must be pivoted to its inclined position by virtue of a downwardly depending pull cord secured to one end of the stop latch.

U.S. Pat. Nos. 1,558,917; 1,470,029; 2,123,188 and 2,168,635 are each directed to locking mechanisms for swinging doors and the like. While each of these references disclose the employment of pivotable members for holding the doors in whatever position they are placed, they are not directed to the employment of such pivotable members with respect to the overhead-type doors. Also, in each of these references, the pivotable members are secured directly to the doors and are operative to engage the ground or floor by pivoting of the pivotable members downwardly. Such mechanisms, however, could not be used in such manner with respect to overhead-type doors.

Accordingly, it is apparent that a need exists for an automatic latching mechanism for overhead-type doors which is operative to automatically latch the door in the raised and closed positions. At the same time, the latching mechanism should not be of a highly complex and complicated design, nor require significant and expensive modifications to existing overhead doors in order for use in connection therewith. Rather, it is desirable that the latching mechanism be readily and easily adapted for retrofitting with respect to existing overhead-type doors.

SUMMARY OF INVENTION

According to the present invention there is provided an automatic latching mechanism which overcomes the above-discussed and other disadvantages, and in particular which provides an effective, uncomplicated device for latching an overhead door in its raised open and lowered closed positions. More particularly, the latching mechanism in accordance with the present invention comprises a pivotable arm having a pivot end and an engagement end, and mounting means for mounting the pivot end of the arm to the frame above the opening with respect to which the door is adapted to move for pivotable movement of the arm about a substantially horizontal axis between a first position and a second position. The engagement end of the arm is adapted to engage a first latch portion associated with the door when the door is in its closed position and the arm is in its first position, and is adapted to engage a second latch portion associated with the door when the door is in its raised position and the arm is in an intermediate position between the first and second positions. The arrangement of the arm relative to the door is such that the door is prevented by the arm for moving into the raised position from its closed position unless the arm is first moved toward the second position out of engagement with the first latch portion, and also such that the door is prevented by the arm from moving to the closed position from the raised position unless the arm is first moved from the intermediate position toward the second position out of engagement with the second latch portion. It will thus be appreciated that in accordance with the present invention, a single pivotable arm member is operative to latch the door in either its closed lower position or its raised upper position by engaging different latch portions associated with the door. In each instance, release of the door from the latched position is accomplished by moving the arm from whatever position it is in toward the second position.

Also, in accordance with a preferred embodiment, the pivotable arm is operative to automatically engage either the first or second latch portions as the door is moved into its respective closed or raised positions. Thus, in accordance with such an arrangement, all that is necessary to latch the door is to move the door to whatever position it is desired.

Further in accordance with a preferred embodiment, the arrangement of the arm relative to the door is such that the path of movement of the engagement end of the arm between the first and intermediate positions is disposed vertically below the respective portions of the path of movement of the first and second stop portions of the door between the closed and raised positions. In this manner, the position of the door in either the closed or raised position is maintained unless the arm is moved away from its respective stop portion towards the second position.

Still further in accordance with a preferred embodiment, means are provided for preventing accidental pivoting of the arm from the first position towards the second position as a result of an attempt to raise the door from its lowered closed position. In the preferred embodiment, this means comprises a counterbalanced pin member which is adapted to freely permit movement of the engagement end of the arm towards the first position but prevent movement from the first position toward the second position. Also, preferably the pivot end of the arm is mounted for sliding movement in its mounting means in order to permit the engagement end to be raised beyond the extent of the counterbalanced pin member and pivoted toward the second position to permit release of the door.

These and further features and characteristics of the present invention will be apparent from the following detailed description in which reference is made to the accompanying figures of the drawing.

DETAILED DESCRIPTION OF THE PREFERRED EMBODIMENT

Figure 1:
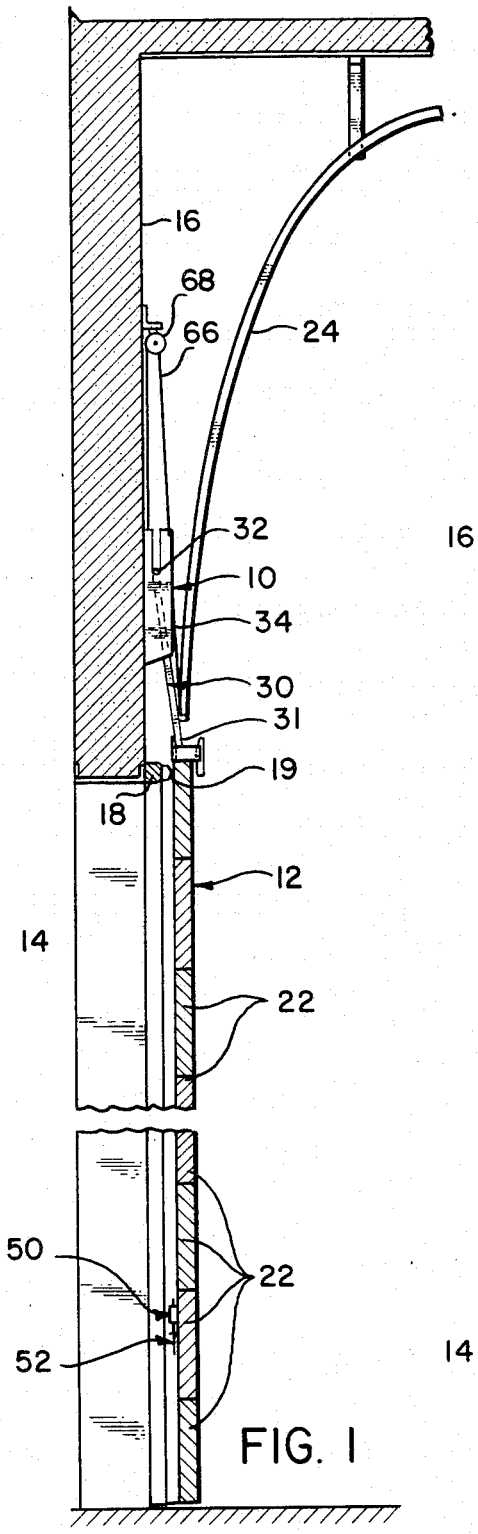
FIG. 1 is a side sectional view of a overhead-type door shown latched in its closed position with a latching mechanism in accordance with the present invention.

Referring now to the drawings wherein like reference characters represent like elements, there is illustrated a latching mechanism 10 in accordance with the present invention for use in connection with latching of an overhead-type door 12 in either its raised or its closed positions. For purposes of the present description, the latching mechanism 10 will be described with reference to its use with a garage of warehouse-type door 12 mounted for sliding movement along a track with respect to an opening 14 provided in the wall of a building. However, it will be appreciated from the description that the latching mechanism 10 in accordance with the present invention could also be used with respect to other overhead-type doors or closures, such as for example those used with respect to tracks, animal cages, trucks, receptacles, and the like.

Figure 4:
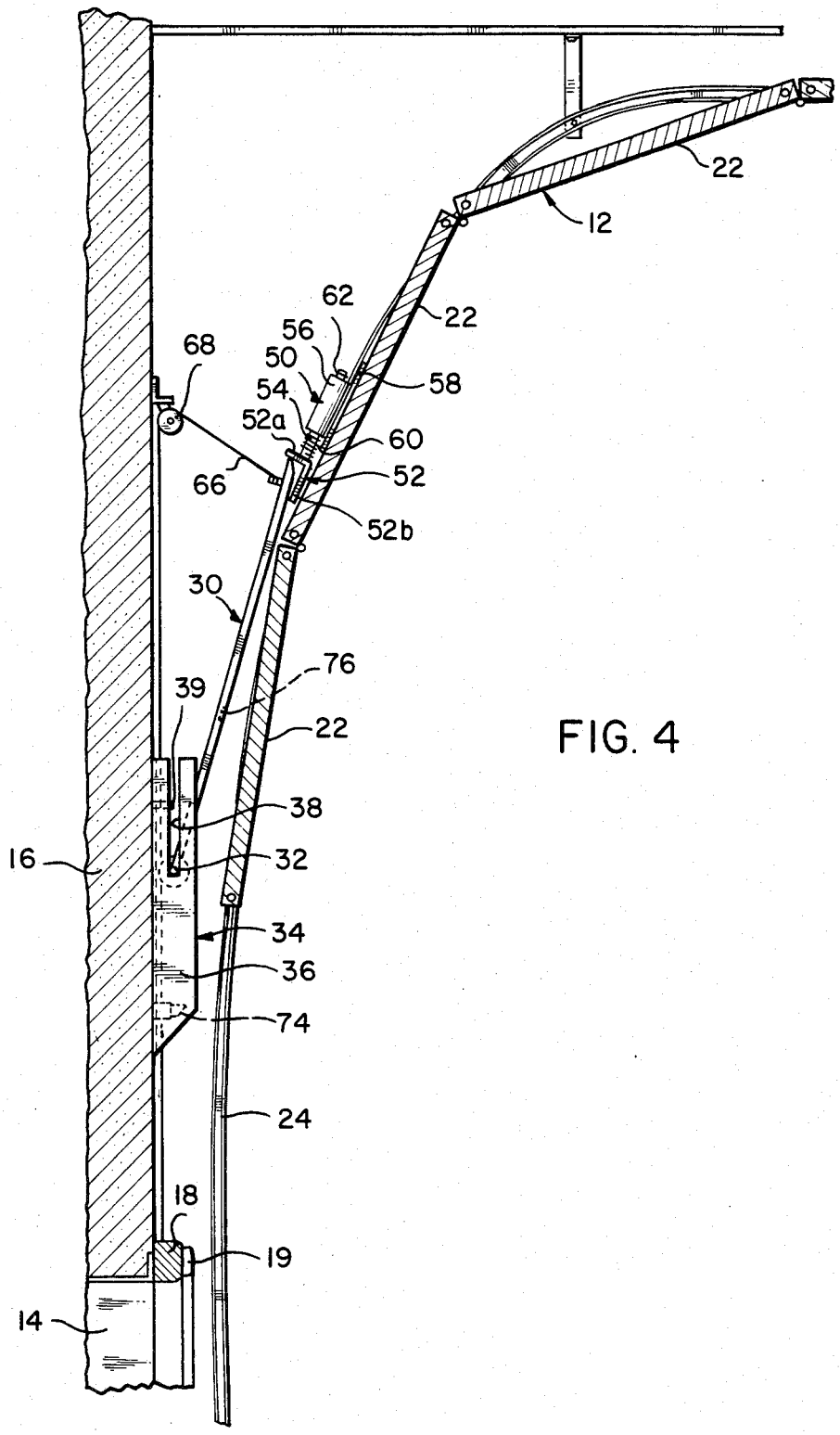
FIG. 4 is an enlarged side sectional view showing the door latched in its raised position with the latching mechanism in accordance with the present invention.

As is conventional, the overhead-type door 12 is mounted for movement between a lowered closed position and a raised open position with respect to an opening 14 defined by suitable framing provided in a wall 16 of a building. The inside of the buiding about the opening 14 may include suitable molding 18 and also possibly sealing means, such as a flexible gasket 19, for engagement with a portion of the door 12 when the door 12 is in its closed lower position. The door 12 may, for example, be comprised of a series of hingedly connected panels or door components 22 provided with bracketed rollers (not shown) on its opposite sides operable to roll in channel portions of guide tracks 24 mounted or secured to the wall 16 or frame 18 surrounding the door opening 14. The rollers and tracks 24 serve to guide the door 12 for movement between a lowered closed position shown in FIG. 1 (in which the opening is closed to prevent entry into the building) and a raised open position such as shown in FIG. 4. A suitable drive mechanism, such as a motor and coupling means may be provided, if desired, for moving of the door between the lower and raised positions, or alternatively, a suitable cable and pulley arrangement may be provided for manual opening and closing of the door 12.

The latching mechanism 10 of the present invention is operative to automatically latch the overhead door 12 in either its closed position or its raised position, and comprises a pivotable arm 30 mounted above the opening 14 for pivotable movement about a substantially horizontal axis. More particularly, in the preferred embodiment, the arm 30 is provided at one end with a transversely extending rod or cylindrical pins 32 which are received in a mounting bracket 34 secured to the wall 16 above the door opening 14 centrally between the sides of the door opening 14. The mounting bracket 34 in the preferred embodiment comprises a generally U-shaped bracket whose spaced side walls 36 are provided with vertically extending slots or channels 38 which receive the transversely extending rod or pins 32 of the arm 30 so as to permit pivoting movement of the arm 30, as well as vertical sliding movement of the pivot end of the arm 30, as discussed more fully hereinbelow.

Figure 2:
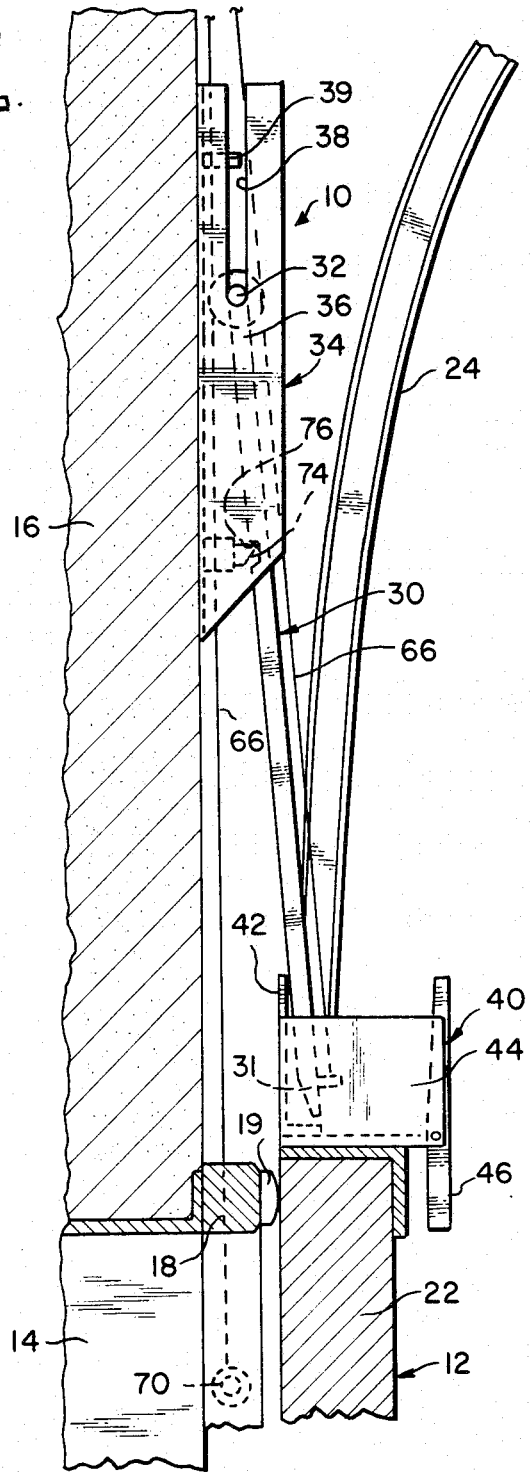
FIG. 2 is an enlarged side sectional view of an upper portion of the door and the latching mechanism shown in FIG. 1, illustrating the manner in which the door is latched in its closed position.

The free end 31 of the arm 30 is chamfered or beveled, and is adapted to engage a latching bracket 40 secured to the upper edge of the door 12 when the door 12 is in its closed position, as best seen in FIGS. 1 and 2. The latching bracket 40 may be mounted to the door 12 in any suitable manner so as to be aligned with the mounting bracket 34 and includes an upwardly extending front surface 42 to prevent pivoting of the arm 30 beyond the front surface of the door 12, and a pair of side plates 44 to which is secured a counterbalanced latch pin 46 which is operative to permit the free end 31 of the arm 30 to enter the latching bracket 40 but which prevents movement of the arm 30 out of the bracket 40 unless it is first moved vertically to clear the latch pin 46. As can best be seen in FIGS. 2 and 5, the latch pin 46 is free to pivot in a counterclockwise direction as shown in the figures but is prevented from pivoting clockwise from its generally vertical position.

A second latching bracket 50 for latching of the door 12 in its raised position is mounted to the lower front surface of the door 12, as best seen in FIGS. 1 and 4. The second latching bracket 50 is also aligned with the mounting bracket 34 and arm 30 and is adapted to be engaged by the free or engagement end 31 of the pivotable arm 30, but in this instance, only when the door 12 is moved to its raised open position as shown in FIG. 4. The latching bracket 50 includes an angled engagement member 52 carried by a post 54 which is received within a bore of a block 56 secured to one of the lower front panels 22 of the door 12 by means of a suitable mounting plate 58. A spring member 60 is interposed between the angled engagement member 52 and the block 56, and serves to urge the angled engagement member 52 away from the block 56. The post 54 preferably includes a spline along its length which is engaged by a pin (not shown) in the block 56 so that the post 54 will not rotate within the block 56 but is permitted to move axially. A stop member, such as a cotter pin 62, is provided in the post 54 to maintain the post 54 mounted in the block 56. It will thus be appreciated that the angled engagement member 52 is adapted to be movable with respect to the mounting plate 58, and thus the door, and is normally biased away from the block 56.

As best seen in FIG. 4, the second latching bracket 50 is mounted to the door 12 so that the free or engagement end 31 of the pivotable arm 30, when the door 12 is in its raised position and the arm 30 has been pivoted counterclockwise relative to its lower position, engages the angled engagement member 52. The provision of the spring 60 and the mounting arrangement of the angled engagement member 52 serves to provide a buffering or shock absorbing function when the door 12 is latched by the arm 30. In particular, the beveled free end 31 of the arm 30 is adapted to engage the transverse flange portion 52*a* of the engagement member 52 in a manner to prevent downward movement of the door 12 toward its closed position. In this regard, the transverse flange portion 52*a* is oriented relative to the parallel flange portion 52*b* such that downward urging of the door 12 will not cause the arm 30 to slip off of the flange portion 52*a* and pivot counterclockwise.

In order to release the door 12 from either the closed or raised positions, the arm 30 must be pivoted upwardly from its respective latching position, i.e., it must be moved in a counterclockwise direction (as viewed in the figures) from either the lower latching position or the upper latching position. While such pivoting of the arm 30 can be accomplished by any suitable means, in accordance with the preferred embodiment, a cable 66 is provided which has one end attached adjacent the free end 31 of the arm 30. The cable 66 extends upwardly to a suitable pulley arrangement 68 (see FIG. 1), and then downwardly to a position where it is capable of being pulled by a person. Conveniently, the cable 66 may be provided with a pull ring 70 on its end, and the pulley arrangement 68 may be such that the pull ring 70 is located to one side of the opening 14 inside the building. Of course, depending upon how release of the latching mechanism 10 is desired, other suitable means could be employed as well as other pulley arrangements. For example, it might be desired to have the release mechanism located on the outside of the door (for example if the latch mechanism were used with respect to a door on a truck or an animal cage).

The operation and functioning of the latch mechanism 10 in accordance with the present invention will now be described.

With the overhead door 12 in its closed position, i.e., so as to close the opening 14 and prevent access therethrough, and with the arm 30 assuming its normal free position due to the effect of gravity, the engagement or free end 31 of the arm 30 will be received within the first latching bracket 40 on the top edge of the door 12 as shown in FIGS. 1 and 2. In this position, the door 12 will be latched in its closed position and prevented from moving into the raised position unless the latch mechanism 10 is released by movement of the arm 30 out of engagement with the first latching bracket 40. More particularly, upward movement of the door 12 of more than a few inches will be prevented by virtue of the free end 31 of the arm 30 being received within the latching bracket 40. If the door 12 were attempted to be lifted upwardly, the pivot end of the arm 30 would move upwardly within the slots 38 until it is blocked by stop pins 39 arranged at the upper extent of the channels 38. Any movement of the engagement end 31 of the arm 30 outwardly during this limited movement of the door 12 upwardly will be prevented by the counterbalanced latch pin 46 on the first latching bracket 40. Thus, any intrusion into the building from the outside is effectively prevented.

Figure 3:
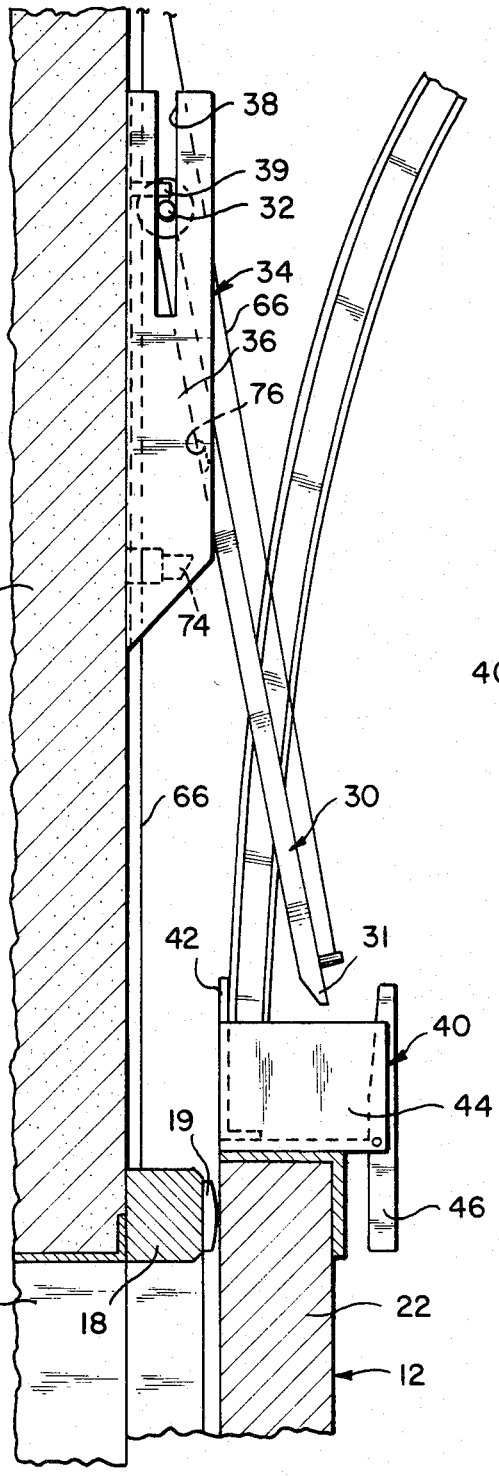
FIG. 3 is an enlarged side sectional view similar to FIG. 2 but showing the pivotable arm of the latching mechanism in accordance with the present invention being moved out of engagement with the door to permit the door to be moved into its raised position.

When it is desired to open the door 12, the free end of the cable 66 is pulled downwardly. This will serve to cause the pivot end of the arm 30 to move upwardly within the slots 38 in the mounting bracket 34 until the transverse rod or pins 32 engage the stop pins 39. Then, as the cable 66 is continued to be pulled, the arm 30 will pivot in a counterclockwise direction until it is free of the latching bracket 40. In this regard, the limited extent of sliding movement of the pivot end of the arm 30 within the mounting bracket 34 is sufficient to allow the free end 31 of the arm 30 to clear the latching pin 46 on the door 12, as shown in FIG. 3.

In order to insure that the arm will pivot in the counterclockwise direction, preferably a cam member 74 is provided on the mounting bracket 34 which acts to urge the free end 31 of the arm 30 slightly outward away from the mounting bracket 34 as the arm 30 is moved upwardly. This will thus insure that the end of the cable 66 at the free or engagement end 31 of the arm 30 will be displaced rearwardly from the vertical a slight extent, whereby pulling of the cable 66 serves to pivot the arm 30 counterclockwise. In the preferred embodiment, the cam member comprises a pin 74 having a beveled end surface which is received in a chamfered recess 76 in the arm 30. The length of the camming pin 74, of course, is dependent on the degree of offset from the vertical between the door 12 and the inside surface of the wall or frame 16 to which the mounting bracket 34 is secured. If a significant offset is provided so that the engagement or free end 31 of the arm 30 is inclined from the vertical when it is in its lower latching position, then a camming pin 74 would not be necessary.

Once the free end 31 of the arm 30 is clear of the first latching bracket 40, the door 12 may be moved or lifted upwardly along its tracks 24. Since the arm 30 extends rearwardly of the door 12, as the door 12 is raised the arm 30 will be pivoted by the upper end of the door 12 itself, and thus it is not necessary to continue pulling the cable 66. That is, in accordance with the present invention, it is only necessary to pull the cable 66 until the arm is free of the first latching bracket 40 on the door 12 and the door 12 has begun to be raised. As the door 12 is continued to be raised, the arm 30 will continue to be rotated counterclockwise until the arm 30 is in a position such that the free or engagement end 31 rides along the front surface of the door 12, i.e., the free end 31 of the arm 30, because of gravity, contacts the front surface of the door 12, but allows the door to still move freely upward. In this regard, any protruding components or elements on the front of the door 12 will simply serve to pivot the arm freely upwardly, i.e., further in a counterclockwise direction, so that the door 12 may move freely past the free end 31 of the arm 30.

When the door 12 reaches its raised position, the engagement or free end 31 of the arm 30 will be positioned intermediate the transverse portion 52*a* of the angled engagement member 52 of the second latching bracket 50 and the bottom of the door 12 as shown in FIG. 4. In this position, any movement of the door 12 towards the closed position will cause the end 31 of the arm 30 to be urged by the transverse portion 52*a* toward the front of the door 12, so as to wedge it in place and thus prevent further downward movement of the door 12. More particularly, as the transverse portion 52*a* of the angled member 52 engages the free end 31 of the arm 30 and attempts to move downwardly, the arm 30 is urged to rotate in a clockwise direction. However, movement of the arm 30 in this direction is prevented by the parallel portion 52*b* of the angled member 52. Here it should be noted that the path of movement of the free end 31 of the arm 30 is located below respective portions of the path of movement of the angled member 52 defined by the tracks 24 for the door 12. Thus, by applying a force to urge the door 12 downwardly, the arm 30 and door 12 become locked in place—the arm 30 cannot move clockwise because of the door 12 and the door 12 cannot move downwardly because of the arm 30.

Figure 5:
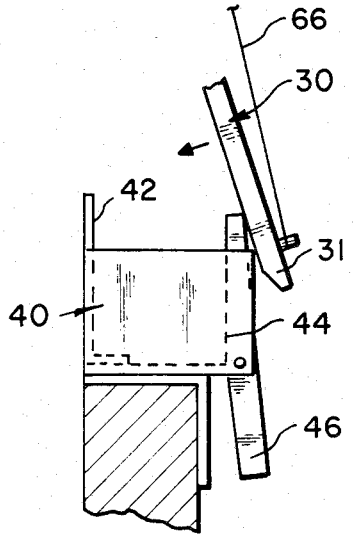
FIG. 5 is a partial side view of the door and latching mechanism, illustrating the pivotable arm of the latching mechanism being moved into its latching position for latching of the door in its closed position.

In order to release the latch mechanism 10 from latching the door 12 in its raised position, it is necessary to once again pull the cable 66 to pivot the arm 30 further in a couterclockwise direction to disengage the engagement of the end 31 of the arm 30 from the second latching bracket 50 and allow the second bracket 50 to pass freely by the arm 31 as the door 12 moves downwardly. After the bracket 50 is past the free end 31 of the arm 30, the cable 66 may be released. As a result of the effect of gravity, the free end 31 of the arm 30 will rest against the surface of the door 12 as it moves downwardly toward the closed position. In this regard, the beveled surface of the free end 31 of the arm 30 is important in order to allow the free end 31 of the arm 30 to ride along the front surface of the door 12. When the door 12 is moved to its closed position, with the arm pivoting downwardly as a result of gravity, it will be appreciated that the free end 31 will contact the upper part of the counterbalanced pin 46 and pivot same counterclockwise, as shown in FIG. 5. This will thus allow the free end 31 of the arm 30 to enter the first latching bracket 40 and move into position to latch the door 12 in its lowered closed position.

Thus, from the above description, it will be appreciated that the automatic latching mechanism 10 in accordance with the present invention provides an efficient and effective latching mechanism 10 of an uncomplicated construction. The latch mechanism 10 may be easily fitted to existing overhead-type door structures with a minimum amount of effort. Specifically, all that is necessary is attachment of two latching brackets 40, 50 to appropriate portions of the door 12 itself and mounting of the mounting bracket 34 for the pivotable arm 30 to the frame structure of the wall 18 above the opening 14 with respect to which the door 12 moves.

It is important to note that in accordance with the present invention, latching is achieved with the pivotable arm 30 as a result of the particular path of movement of the free end 31 of the arm 30 relative to the respective latching brackets 40, 50 on the door 12. More particularly, the path of movement of the free end 31 of the arm 30 during pivoting, between the lowered latching position and the raised latching position, is vertically disposed below respective portions of the paths of movement of the first and second latching brackets 40, 50 respectively, and it is because of this relationship that the latching effects are achieved. That is, when the arm 30 is in its lowered position, in order for the door 12 to move upwardly along the guide tracks 24, it is necessary that the arm 30 may be pivoted rearwardly in a counterclockwise direction. However, such movement is normally prevented by the counterbalanced latching pin 46 of the first latching bracket 40. Thus, the free end 31 of the arm 30 will be maintained in its latching position unless the arm 30 is lifted vertically so that the free end 31 will clear the latching pin 46. After it has been moved to clear the pin 46, the path the free end 31 travels will be vertically below respective portions of the path followed by the first latching bracket 40. Similarly, when the arm 30 is in its second latching position in engagement with the second latching bracket 50, movement of the door 12 towards the closed position will be prevented unless the arm is again moved out of latching engagement with the bracket 50 since the path of travel of the door 12 and the second latching bracket 50 is vertically above that along which the arm 30 travels downwardly. Again, in order to release the door 12 from its raised position, it is necessary to pivot the arm 30 counterclockwise to disengage the free end 31 from the second latching bracket 50.

As will be appreciated, the length of the pivotable arm 30 and the positioning of the mounting bracket 34 and the latching brackets 40, 50 are dependent on one another and on the nature of movement of the door 12 along its tracks 24. Basically, in accordance with the preferred embodiment, the arrangement of the arm 30 is such that the path of pivoting movement of the free end 31 of the arm 30 will be vertically disposed below the path of movement of the respective latch brackets 40, 50. Typically, the length of the arm 30 will be on the order of 10–16 inches and the mounting bracket 34 will be secured to the wall 16 in a position such that the first latching bracket 40 on the door 12 is engaged by the free end 31 of the arm 30 when the door 12 is in its closed position so as to prevent the door 12 moving into its raised position unless the arm 30 is first moved out of its latching position. Limited movement of the door 12 toward the raised position, for example on the order of 2–3 inches, is permitted in the preferred embodiment in light of the limited vertical movement of the arm 30 within its mounting bracket 34 so as to move the free end 31 to clear the counterbalanced latch pin 46. The second latching bracket 50 is then secured to the front of the door 12 in a position such that it will be engaged by the free end 31 of the arm 30 when the door 12 is in the desired raised position. Here it should be noted that this positioning of the second latching bracket 50 is dependent on the nature of movement of the door 12 as governed by the guide tracks 24. Also, with the preferred embodiment, the orientation of the transverse portion 52*a* of the angled engagement member 52 is chosen so as to insure that the free end 31 of the arm 30 engaged thereby is urged toward the door 12 when the door 12 is urged downwardly from its raised position. This again is dependent on the nature of the movement of the door 12 as well as the position of the arm 30 in its raised latching position.

It will thus be appreciated that other mounting arrangements and latching bracket constructions could be employed in accordance with the broad principles of the present invention. For instance, the first latching bracket 40 could be mounted on the rearward upper surface of the door 12, as opposed to the top edge of the door 12 as in the perfect embodiment. Also, instead of providing a counterbalanced latch pin 46 for preventing movement of the arm 30 out of engagement with the first bracket 40, a spring biased latch could be provided and released by means of a separate cable or other device. As for the second bracket member 50, various other arrangements are also possible, such as for example, pin in socket or slotted opening arrangements. Also, movement of the arm 30 out of the latching positions to the release positions could be accomplished with suitable types of camming arrangements or various types of mechanical or electrical drive arrangements if desired. All of such alternative types of arrangements, as well as others, are within the purview of the broad principles and aspects of the present invention, as will be readily understood to persons of ordinary skill in light of the present description.

Thus, in accordance with the broad principles of the present invention, there is provided a latching mechanism 10 for overhead-type doors 12 mounted for movement with respect to an opening 14 defined by a frame. The latching mechanism 10 includes a pivotable arm 30 having a pivot end and an engagement end 31, and means for mounting 34 the arm 30 for pivoting movement about a substantially horizontal axis disposed above the opening 14. The arm 30 is adapted to be moved between a first lowered position and a second raised position. When the door 12 is in its closed position, the engagement end 31 of the arm 30 is adapted to engage a first latch portion (latching bracket 40) associated with the door 12 when the arm 30 is in its first lowered position, and when the door 12 is in its raised position, the engagement end 31 of the arm 30 is adapted to engage a second latch portion (latching bracket 50) associated with the door 12 when the arm 30 is in an intermediate position between its lowered position and its raised position. The arrangement of the arm 30 relative to the door 12 is such that the door 12 is prevented by the arm 30 from movement into its raised open position from its closed position unless the arm 30 is first moved toward the second position out of engagement with the first latch portion 40, and such that the door 12 is prevented by the arm 30 from moving from the raised position to the closed position unless the arm 30 is first moved from its intermediate position toward the second position out of engagement with the second latch portion 50. In this manner, the door 12 will be latched in either its raised position or its closed position by the very same arm 30 by virtue of the engagement of the pivotable arm 30 with respective first and second latch portions 40, 50 associated with the door 12. Unlatching of the door 12 from its latched positions is accomplished in both instances by pivoting movement of the arm 30 toward the second raised position until the engagement end 31 is out of engagement with the respective latch portions 40, 50.

While the preferred embodiments of the present invention have been shown and described, it will be understood that such are merely illustrative and that changes may be made without departing from the scope of the invention as claimed.

What is claimed is:

1. A latching device for overhead-type doors which are mounted for movement between a closed position and a raised position with respect to a door opening defined by a frame, said latching device comprising:

a pivotable arm having a pivot end and an engagement end;

mounting means for mounting said pivot end of said arm above the door opening for pivoting movement about a substantially horizontal axis between a first position and a second position;

said engagement end of said arm being adapted to engage a first latch portion associated with said door when said door is in said closed position and said arm is in said first position, and adapted to engage a second latch portion associated with said door when said door is in said raised position and said arm is in an intermediate position between said first and second positions, said first latch portion comprising a first latch bracket adapted to be mounted to said door adjacent an upper portion of said door; and the arrangement of said arm relative to said door being such that said door is prevented by said arm from moving into said raised position from said closed position unless said arm is first moved toward said second position out of engagement with said first latch bracket and such that said door is prevented by said arm from moving from said raised position to said closed position unless said arm is first moved from said intermediate position toward said second position out of engagement with said second latch portion, and said first latch bracket including a counterbalanced pin member for preventing accidental pivoting movement of said arm as a result of an attempt to move said door from said closed position toward said raised position, said pin member being operative to freely permit said engagement end of said arm to move in a first direction past said pin member into said first position and operative to prevent movement of said engagement end of said arm in a second direction from said first position toward said second position.

2. The latching device of claim 1 wherein said mounting means also mounts said pivot end of said arm for sliding movement relative to said frame to thereby permit said engagement end of said arm to be moved out of interfering relationship with said pin member to thereby allow movement of said engagement end of said arm in said second direction.

3. The latching device of claim 2 wherein said mounting means comprises a mounting bracket having spaced side walls each of which includes a channel therein, and wherein said pivot end of said arm includes transversely extending pin means adapted to be received in said channels for sliding and pivoting movement with respect to said bracket.

4. The latching device of claim 2, further including cam means interposed between said mounting means and said arm for camming said arm in a direction from said first position toward said second position upon sliding movement of said arm relative to said mounting means.

5. The latching device of claim 1 wherein said second latch portion comprises a second latch bracket adapted to be mounted to said door adjacent a lower portion of said door.

6. The latching device of claim 5 wherein said second latch bracket includes an engagement member and shock absorbing means adapted to be interposed between said engagement member and said door.

7. The latching device of claim 1 wherein said substantially horizontal axis is parallel to the plane having said door opening therein.

8. The latching device of claim 1, further including cable means for moving said arm from said respective first and intermediate positions out of engagement with said respective latch portions, said cable means being connected to said arm adjacent said engagement end and being operative to cause said arm to pivot in the direction of rotation from said first position toward said second position.

9. A latching device for overhead-type doors which are mounted for movement between a closed position and a raised position with respect to a door opening defined by a frame, said latching device comprising:

a pivotable arm having a pivot end and an engagement end;

mounting means for mounting said pivot end of said arm above the door opening for pivoting movement about a substantially horizontal axis between a first position and a second position;

said engagement end of said arm being adapted to engage a first latch portion associated with said door when said door is in said closed position and said arm is in said first position, and adapted to engage a second latch portion associated with said door when said door is in said raised position and said arm is in an intermediate position between said first and second portions, said first latch portion comprising a first latch bracket adapted to be mounted to said door adjacent an upper portion of said door; and the arrangement of said arm relative to said door being such that the path of movement of said engagement end between said first and intermediate positions is disposed vertically below respective portions of the path of movement of said first and second latch portions associated with said door between said closed and raised portions, whereby the position of said door in either said closed or said raised position is maintained unless said arm is moved away from said respective latch portion toward said second position, and said first latch bracket including a counterbalanced pin member for preventing accidental pivoting movement of said arm as a result of an attempt to move said door from said closed position toward said raised position, said pin member being operative to freely permit said engagement end of said arm to move in a first direction past said pin member into said first position and operative to prevent movement of said engagement end of said arm in a second direction from said first position toward said second position.

10. In combination:

an overhead door mounted for movement between a closed position and a raised position with respect to a door opening defined by a frame; and a latching device for latching said overhead door in said closed position and said raised position when said door is moved to said raised or closed position respectively, said latching device comprising: a pivotable arm having a pivot end and an engagement end; mounting means for mounting said pivot end of said arm above said door opening for pivoting movement about a substantially horizontal axis between a first position and a second position; said engagement end of said arm being adapted to engage a first latch portion associated with said door when said door is in said closed position and said arm is in said first position, and adapted to engage a second latch portion associated with said door when said door is in said raised position and said arm is in an intermediate position between said first and second positions, said first latch portion comprising a first latch bracket adapted to be mounted to said door adjacent an upper portion of said door; and the arrangement of said arm relative to said door being such that said door is prevented by said arm from moving into said raised position from said closed position unless said arm is first moved toward said second position out of engagement with said first latch portion and such that said door is prevented by said arm from moving from said raised position to said closed position unless said arm is first moved from said intermediate position toward said second position out of engagement with said second latch portion, and said first latch bracket including a counterbalanced pin member for preventing accidental pivoting movement of said arm as a result of an attempt to move said door from said closed position toward said raised position, said pin member being operative to freely permit said engagement end of said arm to move in a first direction past said pin member into said first position and operative to prevent movement of said engagement end of said arm in a second direction from said first position toward said second position.

11. The latching device of claim 9 wherein said mounting means also mounts said pivot end of said arm for sliding movement relative to said frame to thereby permit said engagement end of said arm to be moved out of interfering relationship with said pin member to thereby allow movement of said engagement end of said arm in said second direction.

12. The latching device of claim 10 wherein said mounting means also mounts said pivot end of said arm for sliding movement relative to said frame to thereby permit said engagement end of said arm to be moved out of interfering relationship with said pin member to thereby allow movement of said engagement end of said arm in said second direction.

* * * * *